US006596668B2

(12) United States Patent
Kuroda et al.

(10) Patent No.: US 6,596,668 B2
(45) Date of Patent: Jul. 22, 2003

(54) HEAT-SENSITIVE RECORDING MATERIAL

(75) Inventors: Takashi Kuroda, Chiba (JP); Kazuhiro Yamada, Chiba (JP); Takahiro Hattori, Chiba (JP)

(73) Assignees: Chisso Corporation, Osaka (JP); Chisso Petrochemical Corporation, Tokyo (JP)

( * ) Notice: Subject to any disclaimer, the term of this patent is extended or adjusted under 35 U.S.C. 154(b) by 124 days.

(21) Appl. No.: 09/796,465

(22) Filed: Mar. 2, 2001

(65) Prior Publication Data

US 2002/0198105 A1 Dec. 26, 2002

(30) Foreign Application Priority Data

Mar. 3, 2000 (JP) ..... 2000-058998

(51) Int. Cl.[7] ..... B41M 5/40
(52) U.S. Cl. ..... 503/200; 428/304.4
(58) Field of Search ..... 503/200, 226; 428/304.4

(56) References Cited

U.S. PATENT DOCUMENTS

| | | | | |
|---|---|---|---|---|
| 4,996,182 | A | 2/1991 | Matsui et al. | 503/200 |
| 5,068,155 | A | 11/1991 | Yamada et al. | 428/515 |
| 5,082,900 | A | 1/1992 | Kuroda et al. | 525/211 |
| 5,114,638 | A | 5/1992 | Kuroda et al. | 264/41 |
| 5,180,626 | A | 1/1993 | Ishibashi et al. | 428/213 |

FOREIGN PATENT DOCUMENTS

| | | |
|---|---|---|
| JP | 4-219276 | 8/1992 |
| JP | 6-122271 | 5/1994 |

*Primary Examiner*—Bruce H. Hess
(74) *Attorney, Agent, or Firm*—Wenderoth, Lind & Ponack, L.L.P.

(57) ABSTRACT

Provided is a heat-sensitive recording material which uses a polyolefin resin as a base for a support but brings about less inferior appearance such as curling and irregularities and which has an excellent resolution and can provide a vivid recorded image in a high density. The heat-sensitive recording material comprises a void-containing stretched film comprising a crystalline polypropylene resin and dicyclopentadiene petroleum resin as essential components and a heat-sensitive recording layer formed on a surface thereof.

4 Claims, No Drawings

HEAT-SENSITIVE RECORDING MATERIAL

BACKGROUND OF THE INVENTION

1. Field of the Invention

The present invention relates to a heat-sensitive recording material which has an excellent resolution and can provide a vivid recorded image in a high density and which brings about less inferior appearance such as curling and irregularities after recording.

2. Description of the Related Art

In general, known is a heat-sensitive recording material prepared by providing a heat-sensitive color developing layer on a support such as paper, synthetic paper or a plastic film. Contained in the heat-sensitive color-developing layer are a colorless or light-colored developing material, a developer, a binder, a filler, a sensitizer, a lubricant and other auxiliary agents, and a color-developed image is obtained by momentary chemical reaction caused by heating by means of a hot pen or a thermal head.

A recording apparatus for such heat-sensitive recording material is inexpensive and small-sized, and maintenance thereof is easy, so that it is widely used as a recording medium in printers for a facsimile, various calculators, medical instruments, an automatic ticket distributor, a heating copying machine and other various apparatuses.

In particular, a heat-sensitive recording material comprising a support of synthetic paper or a plastic film is used when a water resistance and a strength are required or an image printer in which a uniformity and a high resolution are required to a recorded image is used.

Most synthetic papers and plastic films used as a support for a heat-sensitive recording material are produced by using a polyolefin resin or a polyester resin as a base, blending it with a white inorganic pigment and stretching it in machine direction and in transverse direction in order to provide it with a whiteness and a cushioning property.

Among them, in the case of a heat-sensitive recording material using a polyolefin resin as a base for a support, there has been the problem that recording in a high density by means of a thermal head results in allowing the support to shrink due to transmission of heat to bring about inferior appearance such as curling and irregularities. In order to solve these problems, a method in which a support is subjected to heat treatment in a rolling state is proposed, but it is not necessarily satisfactory. On the other hand, in the case of a heat-sensitive recording material using a polyester base resin as a base for a support, curling and irregularities are not caused, but the cost grows high. Accordingly, desired is a heat-sensitive recording material in which an inexpensive polyolefin base resin is used for a base and which brings about less inferior appearance such as curling and irregularities.

SUMMARY OF THE INVENTION

An object of the present invention is to provide a heat-sensitive recording material which uses a polyolefin resin as a base for a support but brings about less inferior appearance such as curling and irregularities and which has an excellent resolution and can provide a vivid recorded image in a high density.

Intensive researches repeated by the present inventors have resulted in finding that the object described above can be achieved by a heat-sensitive recording material in which used as a support is a void-containing stretched film comprising a crystalline polypropylene resin and a dicyclopentadiene petroleum resin as essential components and in which a heat-sensitive recording layer is formed on a surface thereof, and thus they have completed the present invention.

The present invention comprises the following structures.

(1) A heat-sensitive recording material comprising a void-containing stretched film comprising a crystalline polypropylene resin and a dicyclopentadiene petroleum resin as essential components and a heat-sensitive recording layer formed on a surface thereof (2) The heat-sensitive recording material as described in the above item (1), wherein the void-containing stretched film comprising a crystalline polypropylene resin and a dicyclopentadiene petroleum resin as essential components is a void-containing laminated stretched film obtained by laminating a surface layer film comprising a composition of the crystalline polypropylene resin on both faces of a base layer film comprising a composition prepared by blending 5 to 180 parts by weight of a dicyclopentadiene petroleum resin having a softening point (ring and ball method) of 160 to 200° C. with 100 parts by weight of the crystalline polypropylene resin and then stretching it at an area magnification of 5 times or more.

(3) The heat-sensitive recording material as described in the above item (1), wherein the void-containing stretched film comprising a crystalline polypropylene resin and a dicyclopentadiene petroleum resin as essential components is a compression-treated void-containing laminated stretched film obtained by hot-compressing the void-containing stretched film as described in the above item (2) at a temperature of 50 to 160° C. and a pressure at which the void-containing laminated stretched film described above does not become transparent.

DETAILED DESCRIPTION OF THE PREFERRED EMBODIMENTS

The embodiment of the present invention shall be explained below.

In the heat-sensitive recording material of the present invention, the void-containing stretched film which is the support is a void (fine void)-containing single layer stretched film or a void-containing laminated stretched film obtained by stretching at an area magnification of 5 times or more, a single layer non-stretched film sheet obtained from a resin composition (hereinafter referred to as a resin composition for a void-containing stretched film) comprising a crystalline polypropylene resin and a dicyclopentadiene petroleum resin as essential components or a laminated non-stretched film sheet which comprises the single layer non-stretched film sheet described above as a base layer and in which a surface layer film comprising a composition of the crystalline polypropylene resin is laminated on at least one face of the base layer.

The crystalline polypropylene resin used for the resin composition for the void-containing stretched film described above or the composition (hereinafter referred to as the resin composition for the surface layer film) of the crystalline polypropylene resin for the surface layer film described above is a crystalline homopolymer of propylene, a binary or higher copolymer of propylene with at east one selected from ethylene and α-olefin having 4 or more carbon atoms or a mixture thereof. To be specific, it includes propylene base polymers having a crystal melting point such as crystalline polypropylene containing a boiling heptane-insoluble part of 70% or more, preferably 80% or more, and crystalline propylene copolymers containing a propylene component of 70% or more, such as a crystalline ethylene·propylene copolymer, a crystalline propylene·1-butene copolymer, a crystalline propylene·1-hexene copolymer and a crystalline ethylene·propylene·1-butene copolymer.

The crystalline polypropylene resins used for the resin composition for the void-containing stretched film and the resin composition for the surface layer film may be the same or different.

The crystalline polypropylene resin has a melt flow rate (measured on a condition 14 (test temperature: 230° C. and test load: 21.18 N) shown in Table 1 of JIS K-7210 [Flow test method of thermoplastic plastics], hereinafter referred as MFR) of 0.5 to 20 g/10 minutes, preferably 0.5 to 10 g/10 minutes.

The dicyclopentadiene petroleum resin used for the resin composition for the void-containing stretched film described above has preferably a softening point (ring and ball method) of 160 to 200° C.

If the dicyclopentadiene petroleum resin has a softening point (ring and ball method) of lower than 160° C., the void-containing single layer stretched film is not obtained by stretching the single layer non-stretched film or sheet obtained from the resin composition for the void-containing stretched film. On the other hand, if it exceeds 200° C., the dispersibility into the crystalline polypropylene resin tends to be reduced.

The dicyclopentadiene petroleum resin having a softening point (ring and ball method) of 160 to 200° C. includes petroleum resins which are high polymers containing a cyclopentadiene component of 50% by weight or more and having a softening point (ring and ball method) failing in a range of 160 to 200° C. and which have a high softening point among petroleum resins obtained by polymerizing fractions comprising as principal components, at least one (hereinafter referred to as a cyclopentadiene component) selected from cyclopentadiene, dicyclopentadiene, alkyl-substituted products and oligomers thereof and mixtures thereof which are obtained by steam cracking of petroleum naphtha, and hydrogenated dicyclopentadiene petroleum resins having a softening point (ring and ball method) of 160 to 200° C. and an iodine value of 20 or less which are obtained by hydrogenating the resins containing a cyclopentadiene component of 50% by-weight or more among the petroleum resins described above under conditions of a temperature of 150 to 300° C. and a hydrogen pressure of 10 to 150 kgf/cm$^2$ in the presence of a solvent with a catalyst comprising metals such as vanadium, nickel and cobalt or an oxide thereof.

In the resin composition for the void-containing stretched film described above, the dicyclopentadiene petroleum resin having a softening point (ring and ball method) of 160 to 200° C. is blended in an amount of 5 to 180 parts by weight, preferably 30 to 180 parts by weight and more preferably 50 to 180 parts by weight per 100 parts by weight of the crystalline polypropylene resin. If a blending amount of the dicyclopentadiene petroleum resin described above is less than 5 parts by weight per 100 parts by weight of the crystalline polypropylene resin described above, caused are the problems that the resulting void-containing stretched film has an unsatisfactory covering property and that the resulting heat-sensitive recording material is short of a cushioning property to deteriorate contact with a thermal head and therefore the image is broken, and brought about is the problem that the inferior appearance such as curling and irregularities is generated. On the other hand, if the blending amount exceeds 180 parts by weight, caused is the problem that when stretching the non-stretched film sheet, breakage takes place very often to deteriorate the processing stability.

In the heat-sensitive recording material of the present invention, if the void-containing stretched film which is the support is a laminated stretched film which comprises a film comprising the resin composition for the void-containing stretched film described above as a base layer film and which is obtained by laminating a surface layer film comprising the composition of the crystalline polypropylene resin on both faces of the base layer film and then stretching it at an area magnification of 5 times or more, the resulting heat-sensitive recording material is particularly reduced in generation of inferior appearance such as curling and irregularities after recording, and therefore it is preferred.

A surface layer film surface of the laminated stretched film described above has to be smooth in order to improve contact with a thermal head, and therefore inorganic fillers having a large particle diameter which may markedly damage the smoothness are not preferably added to the resin composition for the surface layer film.

In the resin composition for the void-containing stretched film described above, an inorganic filler powder can be substituted for a part of the dicyclopentadiene petroleum resin described above as long as the object of the present invention is not damaged. The inorganic filler powder described above includes calcium carbonate, talc, titanium oxide and silica each having an average particle diameter of 0.01 to 20 $\mu$m, preferably 0.01 to 10 $\mu$m and more preferably 0.1 to 5 $\mu$m, and calcium carbonate is advantageous from a viewpoint of a cost. They may be used alone or in combination of two or more kinds thereof.

Various additives which are publicly known to be added to polypropylene, for example, phenolic antioxidants, thioether antioxidants, phosphorus antioxidants, higher fatty acid metal salts such as calcium stearate, lubricants such as fatty acid amides, pigments, foaming agents and polyethylenes and ethylene-propylene rubber as added polymers can be added, if necessary, to the crystalline polypropylene resin used for the resin composition for the void-containing stretched film described above or the resin composition for the surface layer film described above as long as the object of the present invention is not damaged.

The resin composition for the void-containing stretched film described above or the resin composition for the surface layer film described above can be prepared by stirring and mixing the crystalline polypropylene base resin and the additives by means of an ordinary blender or mixer. Further, it can be molten, kneaded and pelletized by means of a conventional extruding machine.

In the present invention, publicly known methods such as a T-die film extrusion method and a blown film extrusion method can be given as examples of a method for obtaining a non-stretched single layer film or sheet from the resin composition for the void-containing stretched film described above. Further, publicly known laminate processing methods such as a co-extrusion method in which molten resins are turned into a multilayer film in a die and an extrusion lamination method in which a surface layer film is further superposed on a base layer film prepared by extrusion are used as a method for obtaining a non-stretched laminated film sheet from the resin composition for the void-containing laminated stretched film.

A stretching method for obtaining the stretched film from the non-stretched film sheet described above and the stretching conditions shall not specifically be restricted. That is, it may be either monoaxial stretching or diaxial stretching, and it is preferably diaxial stretching. Either of publicly known monoaxial and diaxial stretching machines can be used.

The stretching conditions are different depending on the stretching machine used. The temperature is set to not higher than a softening point of the petroleum resin contained in the composition, and the film is stretched at an area magnification of 5 times or more. In the case of diaxial stretching, the area magnification is preferably 9 times or more.

In the case of a diaxial stretching machine, it may be either a simultaneous stretching system or a sequential stretching system.

In the present invention, when stiffness is required to the void-containing single layer stretched film or void-containing laminated stretched film described above which is the support for the heat-sensitive recording material, it is preferably a compression-treated void-containing single layer stretched film or a compression-treated void-containing laminated stretched film obtained by hot-compressing the void-containing single layer stretched film or void-containing laminated stretched film described above at a temperature of 50 to 160° C. and a pressure at which the voids do not disappear.

The hot-compressing described above can be carried out by means of a hot press or a hot-compressing roll.

With respect to the hot-compressing conditions, the void-containing single layer stretched film or void-containing laminated stretched film described above is heated up to 50 to 160° C. and then hot-compressed to a thickness of 50 to 90 based on a thickness of 100 before hot-compressing at a linear pressure of 50 to 400 kg/cm by means of a hot compressing roll. However, if the film is heated too high, the voids described above completely disappear, so that it has to be hot-compressed at a lower hot-compressing temperature than a temperature at which the voids disappear. Further, the voids disappear in a certain case by virtue of pressure, and therefore hot-compression has to be carried out on conditions on which restoration in a thickness direction and disappearance of the voids are not caused while controlling the temperature and the pressure.

In the heat-sensitive recording material of the present invention, a thickness of the void-containing stretched film which is the support shall not specifically be restricted and is preferably 25 to 300 $\mu$m. When the void-containing stretched film is a laminated film, a thickness of the base layer film accounts for 50% or more of a whole thickness of the laminated film.

A density of the void-containing stretched film described above shall not specifically be restricted, and 0.3 to 0.8 g/cm$^3$ can be given as an example thereof.

In the heat-sensitive recording material of the present invention, a heat-sensitive color-developing layer is formed on the surface of the void-containing stretched film which is the support. In the present invention, a method for forming the heat-sensitive color-developing layer described above shall not specifically be restricted, and publicly known methods can be used.

Capable of being given as examples of the heat-sensitive color-developing layer described above are a combination of colorless or pale colored basic dyes with inorganic or organic acid substances, a combination of higher fatty acid metal salts such as ferric stearate with phenols such as gallic acid and a combination of diazonium compounds with couplers and basic substances.

In general, the heat-sensitive color-developing layer can be formed by preparing a heat-sensitive color-developing layer-coating solution by adding to the combination described above, a binder, a filler, a sensitizer, a dispersant, a lubricant and other auxiliary agents such as a UV absorber, an antioxidant, a fluorescent dye, a mold-releasing agent, a water resistant agent and a defoaming agent, coating it on the support and drying it.

Publicly known substances and methods described in, for example, Japanese Patent Application Laid-Open No. 70479/1990, Japanese Patent Application Laid-Open No. 219276/1992 and Japanese Patent Application Laid-Open No. 142034/1997 can be used for specific components used for the heat-sensitive color-developing layer described above and a method for preparing the heat-sensitive color-developing layer-coating solution described above.

In the heat-sensitive recording material of the present invention, the kind and the amounts of various components used for the heat-sensitive color-developing layer-coating solution are decided according to the performances and the recording aptitude required and shall not specifically be restricted. When a combination of a basic dye (a color-developing dye) with an organic acid substance is used for the components of the heat-sensitive color-developing layer-coating solution, usually used are 0.05 to 2 parts of the basic dye, 0.01 to 2 parts of a sensitizer and 0.5 to 4 parts of a filler each per one part of the organic acid substance, and a binder accounts suitably for 5 to 25% of the whole solid matters.

In the heat-sensitive recording material of the present invention, the heat-sensitive color-developing layer-coating solution may be prepared according to the example described above, and commercially available heat-sensitive color-developing layer-coating solutions may be used.

In the heat-sensitive recording material of the present invention, a method for forming the heat-sensitive color-developing layer shall not specifically be restricted, and it is formed by a method in which the coating solution is applied by, for example, air knife coating and blade coating and dried. A coating amount of the coating solution shall not specifically be restricted and is controlled usually in a range of 2 to 12 g/m$^2$ in terms of a dried weight.

In the heat-sensitive recording material of the present invention, an overcoat layer of a high molecular substance can further be provided on the heat-sensitive color-developing layer for the purpose of elevating the protection. Further, an undercoat layer containing an organic filler or an inorganic filler can be provided between the heat-sensitive color-developing layer and the support for the purpose of elevating the protection and the sensitivity.

In the heat-sensitive recording material of the present invention, capable of being suitably used are such various techniques publicly known in the heat-sensitive recording material production field that when the heat-sensitive color-developing layer is formed only on one face of the void-containing stretched film which is the support, a face on which the heat-sensitive color-developing layer is not formed is subjected to adhesive treatment to process the recording material into an adhesive label.

EXAMPLES

The present invention shall specifically be explained below with reference to examples and comparative examples, but the present invention should not be restricted by them. The following evaluation methods were used in the following examples and comparative examples.

(1) Heat-sensitive Recording Material Aptitude

Solid printing was carried out by means of a heat-sensitive printer UP-103 (manufactured by Sony Corporation) to evaluate the following items.

Image Quality

◎: output image is free of starving and breaking

○: a little starving and breaking are observed, but no problems on practical uses are involved Δ: starving and breaking are observed, and problems are involved depending on uses X: severe starving and breaking are observed, and problems on practical uses are involved Curling ◎: curling is scarcely observed ○: curling is observed, but no problems on practical uses are involved X: severe curling is observed, and problems on practical uses are involved Irregularities ◎: irregularities are scarcely observed ○: irregularities are observed, but no problems on practical uses are involved X: severe irregularities are observed, and problems on practical uses are involved Example 1

Preparation of Composition for Film

Put into a Henschel mixer (brand name) as components for a base layer film of a laminated film were 0.2 part by weight of a phenolic antioxidant BHT (brand name), 0.1 part by weight of calcium stearate, 8 parts by weight of a dicyclopentadiene petroleum resin having a softening point of 172° C. and 8 parts by weight of calcium carbonate (average particle diameter: 1.5 μm) each based on 100 parts by weight of a crystalline polypropylene powder containing 96% of a n-heptane-insoluble part and having an MFR of 2 g/10 minutes. They were mixed, stirred and then fed into a co-rotating type twin screw extruder to be molten and kneaded at 240° C. and extruded in the form of a strand. This was cooled down and cut to obtain a pelletized composition for a base layer film.

Put into the Henschel mixer (brand name) as components for a surface layer film of the laminated film were 0.2 part by weight of the phenolic antioxidant BHT (brand name) and 0.1 part by weight of calcium stearate each based on 100 parts by weight of a polypropylene-ethylene block copolymer powder having an MFR of 1.5 g/10 minutes, an ethylene concentration of 8% and a block index of 0.8%. They were mixed, stirred and then fed into a co-rotating type twin screw extruder to be molten and kneaded at 240° C. and extruded in the form of a strand. This was cooled down and cut to obtain a pelletized composition for a surface layer film.

Preparation of Void-containing Laminated Stretched Film

Used were a three-feed, three-layer film extruding apparatus equipped with a multilayer T die (comprising one single screw extruder for an intermediate layer having an aperture of 65 mmϕ and two single screw extruders for a surface layer having an aperture of 50 mmϕ) and a tenter method biaxial stretching machine, and fed were the composition for the base layer film described above into the single screw extruder for an intermediate layer and the composition for the surface layer film described above into the single screw extruders for a surface layer. They were molten and co-extruded at a T-die temperature of 240° C., followed by quenching it on a specular cooling roll having a surface temperature of 30° C. to obtain a two-feed, three-layer non-stretched film in which a surface layer, a base layer and a surface layer were laminated in this order in a thickness ratio 1:3:1 and which had a total thickness of 3 mm. The non-stretched film thus obtained was introduced into a stretching machine to be stretched by 5 times in machine direction at a temperature of 140° C. between hot rolls and then stretched by 8 times in transverse direction at a tenter temperature of 60 to 210° C., and then it was rolled up to obtain a void-containing laminated stretched film having a total thickness of 80 μm.

Formation of Heat-sensitive Color-developing Layer

A heat-sensitive color-developing layer-coating solution Dythermo DI (manufactured by Dainichiseika Color & Chemicals MFG. Co., Ltd.) was coated on one face of the film described above by means of a bar coater (rod of #14) and dried at 80° C. for 5 minutes to obtain a heat-sensitive recording material sample. The coating amount was 10 g/m$^2$ in terms of a dry weight.

Evaluation Test

This sample was subjected to conditioning in a room of 23° C. and a humidity of 50% for whole day and night and then used for evaluating a heat-sensitive recording material aptitude. The evaluation results thereof are shown in Table 1.

Example 2

Preparation of Composition for Film

A composition for a base layer film and a composition for a surface layer film were obtained according to the method described in Example 1, except that the blending amounts of the dicyclopentadiene petroleum resin and calcium carbonate which were blended with the composition for the base layer film were changed as shown in Table 1.

Preparation of Compressed Void-containing Stretched Film

The composition described above was used to obtain a void-containing laminated stretched film sample according to the method described in Example 1, and then the stretched film described above was subsequently hot-compressed at a linear pressure of 200 kg/cm by means of a pair of metal rolls heated at 110° C. to obtain a compressed void-containing laminated stretched film sample having a thickness of 80 μm.

The heat-sensitive color-developing layer-coating solution was coated on this film sample according to the method described in Example 1, and the resulting heat-sensitive recording material sample was used for the evaluation test. The evaluation results thereof are shown in Table 1.

Comparative Examples 1 and 2

Heat-sensitive recording material samples were prepared according to the method described in Example 2, except that the blending amounts of the dicyclopentadiene petroleum resin and calcium carbonate which were blended with the composition for the base layer film were changed as shown in Table 1, and they were used for the evaluation test. The evaluation results thereof are shown in Table 1.

Comparative Example 3

A heat-sensitive recording material sample was prepared according to the method described in Example 1, except that the blending amounts of the dicyclopentadiene petroleum resin and calcium carbonate which were blended with the composition for the base layer film were changed as shown in Table 1, and it was used for the evaluation test. The evaluation results thereof are shown in Table 1.

TABLE 1

| | Example | | Comparative Example | | |
|---|---|---|---|---|---|
| | 1 | 2 | 1 | 2 | 3 |
| Blending amounts (weight parts)* in base layer film | | | | | |
| Dicyclopentadiene petroleum resin | 8 | 50 | 3 | 0 | 0 |
| Calcium carbonate | 8 | 50 | 20 | 20 | 0 |
| Presence of compressing treatment | None | Present | Present | Present | None |
| Heat-sensitive recording material aptitude | | | | | |
| Image quality | ○ | ◎ | Δ | Δ | X |
| Curling | ○ | ◎ | X | X | X |
| Irregularity | ○ | ◎ | X | X | X |

*blending amounts per 100 parts by weight of the crystalline polypropylene resin Effects of the Invention The heat-sensitive recording material of the present invention has an excellent resolution and can provide a vivid recorded image in a high density, and it brings about less inferior appearance such as curling and irregularities after recording. It can suitably be used as a recording medium in printers for a facsimile, various calculators, medical instruments, a video printer, a heating copying machine and others. Further, it is suited as a recording medium for printing bar codes for a shelf tag and a price tag.

What is claimed is:

1. A heat-sensitive recording material comprising a void-containing stretched film comprising a crystalline polypropylene resin and a dicyclopentadiene petroleum resin as essential components and a heat-sensitive recording layer formed on a surface thereof.

2. The heat-sensitive recording material as described in claim 1, wherein the void-containing stretched film comprising a crystalline polypropylene resin and a dicyclopentadiene petroleum resin as essential components is a void-containing laminated stretched film obtained by laminating a surface layer film comprising a composition of the crystalline polypropylene resin on both faces of a base layer film comprising a composition prepared by blending 5 to 180 parts by weight of a dicyclopentadiene petroleum resin having a softening point (ring and ball method) of 160 to 200° C. with 100 parts by weight of the crystalline polypropylene resin and then stretching it at an area magnification of 5 times or more.

3. The heat-sensitive recording material as described in claim 1, wherein the void-containing stretched film comprising a crystalline polypropylene resin and a dicyclopentadiene petroleum resin as essential components is a compression-treated void-containing stretched film obtained by hot-compressing a void-containing stretched film comprising a crystalline polypropylene resin and a dicyclopentadiene petroleum resin at a temperature of 50 to 160° C. and a pressure at which the void-containing stretched film does not become transparent.

4. The heat-sensitive recording material as described in claim 1, wherein the void-containing stretched film comprising a crystalline polypropylene resin and a dicyclopentadiene petroleum resin as essential components is a compression-treated void-containing laminated stretched film obtained by laminating a surface layer film comprising a composition of the crystalline polypropylene resin on both faces of a base layer film comprising a composition prepared by blending 5 to 180 parts by weight of a dicyclopentadiene petroleum resin having a softening point (ring and ball method) of 160 to 200° C. with 100 parts by weight of the crystalline polypropylene resin, stretching the laminated film at an area magnification of 5 times or more, and hot-compressing the resultant void-containing laminated stretched film at a temperature of 50 to 160° C. and a pressure at which the void-containing laminated stretched film does not become transparent.

* * * * *